US006241158B1

(12) United States Patent
Clark et al.

(10) Patent No.: US 6,241,158 B1
(45) **Date of Patent: *Jun. 5, 2001**

(54) IRRIGATION SPRINKLER WITH PIVOTING THROTTLE VALVE

(75) Inventors: Mike Clark, San Marcos; Pine Vu, San Diego, both of CA (US)

(73) Assignee: Hunter Industries, Inc., San Marcos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/539,645

(22) Filed: Mar. 30, 2000

Related U.S. Application Data

(63) Continuation-in-part of application No. 09/198,911, filed on Nov. 24, 1998, now Pat. No. 6,050,502.

(51) Int. Cl.[7] ..... B05B 17/00
(52) U.S. Cl. ..... 239/1; 239/201; 239/237
(58) Field of Search ..... 239/200–206, 239/237, 240, 242, 263.3, DIG. 1, 465, 580, 581.1, 1; 251/74, 248, 305

(56) References Cited

U.S. PATENT DOCUMENTS

| | | | | |
|---|---|---|---|---|
| 3,113,473 | * | 12/1963 | Morlen | 251/248 |
| 3,323,725 | | 6/1967 | Hruby, Jr. | 239/205 |
| 3,383,047 | | 5/1968 | Hauser | 239/206 |
| 4,562,962 | | 1/1986 | Hartman | 239/200 |
| 4,624,412 | * | 11/1986 | Hunter | 239/205 |
| 4,729,511 | | 3/1988 | Citron | 239/205 |
| 4,796,804 | | 1/1989 | Weiss | 239/1 |
| 4,886,209 | * | 12/1989 | Dawn | 239/205 |
| 4,892,252 | | 1/1990 | Bruninga | 239/205 |
| 5,335,857 | | 8/1994 | Hagon | 239/204 |
| 5,465,752 | | 11/1995 | Higgins | 137/512.5 |
| 5,699,962 | | 12/1997 | Scott et al. | 239/73 |
| 5,762,270 | | 6/1998 | Kearby et al. | 239/205 |
| 6,050,502 | * | 4/2000 | Clark | 239/237 |

* cited by examiner

*Primary Examiner*—Lisa Ann Douglas
(74) *Attorney, Agent, or Firm*—Michael H. Jester

(57) ABSTRACT

A pop-up rotor type irrigation sprinkler has a pivotable butterfly valve body located in its riser just below the nozzle. The valve body is selectively pivotable between fully open and fully closed positions by manually turning a drive member mounted in the upper end of the riser with a hand tool. The drive member is connected to the valve body with a linkage that extends within the riser outside of the water flow path to avoid adversely affecting the water stream ejected from the nozzle. The valve body has an elliptical shape and is curved in section and downwardly concave when in its closed position. Due to its curved shape, the valve body can pivot to its vertical open position in which it rests parallel with the curved cylindrical interior wall of an internal flow tube to minimize flow resistance. Due to its elliptical shape, the valve body can pivot to its substantially horizontal position in which its peripheral edges are snug up against the cylindrical interior wall of an internal flow tube in order to achieve a substantial seal. Tolerance problems that would otherwise be associated with a circular butterfly valve are avoided. The downwardly concave shape of the valve body when in its closed position and its over-the-center pivotal mounting result in the water pressure acting to hold the valve body in its filly closed position until manually pivoted to its open position.

30 Claims, 9 Drawing Sheets

IRRIGATION SPRINKLER WITH PIVOTING THROTTLE VALVE

CROSS-REFERENCE TO RELATED APPLICATION

This application is a continuation-in-part of U.S. patent application Ser. No. 09/198,911 of Mike Clark filed Nov. 24, 1998 entitled ROTARY SPRINKLER WITH MEMORY ARC MECHANISM AND THROTTLING VALVE, which issued as U.S. Pat. No. 6,050,502 on Apr. 18, 2000. Said application is assigned to Hunter Industries, Inc., the assignee of the subject application. The entire disclosure of said U.S. patent application Ser. No. 09/198,911 is specifically incorporated herein by reference.

BACKGROUND OF THE INVENTION

The present invention relates to sprinklers for irrigation, and more particularly, to an irrigation sprinkler with a manually operable valve for selectively stopping the flow of water through an internal passage before it reaches the nozzle.

The climate in many parts of the world dictates the use of irrigation systems to maintain the desired vegetation. One system in widespread use with lawns, gardens, playing fields, golf courses and other forms of landscaping comprises a plurality of sprinklers connected to supply lines that branch off a water source. An electronic controller turns solenoid activated diaphragm valves on and off in accordance with a watering program to deliver water to blocks of sprinklers connected to the same supply line. One common type of sprinkler called a rotor has an outer cylindrical body with a pop-up riser and a replaceable nozzle. A turbine rotates the riser through an adjustable arc to distribute water over a predetermined sector at a preselected uniform precipitation rate. It is often desirable to change out a nozzle to one having a different precipitation rate or to adjust other features of the sprinkler. See for example U.S. Pat. No. 5,699,962 of Scott et al. granted Dec. 23, 1997 and entitled AUTOMATIC ENGAGEMENT NOZZLE, the entire disclosure of which is hereby incorporated by reference. Said patent is also assigned to Hunter Industries, Inc.

Normally the sprinkler must be off to replace the nozzle or perform other adjustments to the sprinkler. This requires that all of the sprinklers connected to a common supply line or branch line be shut off This in turn requires the maintenance worker to walk back and forth between the sprinkler and the diaphragm valve or controller. Alternatively, a helper can de-activate the valve for the particular line or manipulate the controller to shut off the zone that encompasses the sprinkler of interest. Either approach is tedious and inefficient. The diaphragm valve is often buried in a valve box and is difficult to access. Irrigation controllers often have complex controls and the simple turning off of a zone may be a bewildering operation that can result in permanent undesired alteration of the existing watering program.

In some situations it may be desirable to turn off the flow of water at one of a number of sprinklers all controlled by a common solenoid actuated valve. For example, it may be desirable to turn off one or more of several sprinklers in a zone for a number of days or weeks while a given area dries out from over-watering, while still permitting the other sprinklers in the same zone to turn on in accordance with the normal watering program.

It is preferable to turn off the sprinkler with an internal valve that is upstream of the nozzle while the water to the sprinkler is on rather than turning off the diaphragm valve or manipulating the controller. This is because the water pressure to the sprinkler is needed to extend the riser from the sprinkler body for easier access to the nozzle. If the water pressure to a pop-up rotor type sprinkler is turned off, the riser retracts under the force of a riser retraction spring. In this condition, only the top surface of the riser is visible, but the side of the riser is concealed. The removable nozzle is normally seated in a receptacle in the riser housing that opens on the side of the riser housing. Some pop-up rotor type sprinklers have slots or recesses in the top surface of the riser into which a tool may be inserted to manually pull the riser upwardly and out of the sprinkler body when the water pressure to the sprinkler is off. However, it is cumbersome to pull the riser out in this matter, and hold it extended while at the same time removing and replacing the nozzle from the side of the sprinkler body.

In designing a sprinkler with an internal flow stop valve there are certain practical constraints that limit the options available. For example, the valve should be manually operable from the top of the sprinkler. However, since the riser of a pop-up rotor contains a complex internal structure, there is very little space available for an internal valve. The valve must be located below the replaceable nozzle since the water must be shut off before the nozzle to allow the nozzle to be removed and replaced. This in turn necessitates the use of some sort of a linkage between the valve and the top of the sprinkler so that a tool can be used to manually turn the valve on and off. If the linkage intercepts the flow passage to the nozzle, a water-tight seal around the linkage is then required.

One sprinkler that has heretofore been designed to overcome the foregoing difficulties is disclosed in U.S. Pat. No. 5,762,270 of Kearby et al. granted Jun. 9, 1998 and entitled SPRINKLER UNIT WITH FLOW STOP. Said patent is also assigned to Hunter Industries, Inc. The sprinkler disclosed in said patent includes a valve in a passage leading to the nozzle which may be turned on and off by twisting a tool inserted in a slot in a cylindrical actuating member accessible from the top of the sprinkler. When the actuating member is rotated a spiral cam mechanism causes it to move axially in a vertical direction. This vertical motion is conveyed via an actuating rod to a circular valve body to move it into and out of engagement with a valve seat in a central water passage leading to the nozzle. The problem with this sprinkler is that there can be an excessive amount of flow resistance to water flowing through the passage and around the valve body to the nozzle when the valve is open. Additional flow resistance is generated by the shaft that extends through the water flow path and connects the actuating member and the circular valve body. This flow resistance has been found to adversely affect the spray pattern from the nozzle, such as by limiting the range or throw of the water stream ejected from the nozzle or otherwise degrading its spray pattern.

Accordingly, it would be desirable to provide an irrigation sprinkler with an improved internal manually operable flow stop valve that has less adverse impact on the hydrodynamic flow characteristics in the water flow path leading to the nozzle.

SUMMARY OF THE INVENTION

According to the present invention a sprinkler includes a housing having a water flow path extending therethrough. A nozzle is mounted in an upper end of the housing and provides an extension of the water flow path for distributing a stream of water outward from the housing. A valve body is pivotable in the water flow path between a first position in which it which the water flow path is substantially open and a second position in which the valve body substantially obstructs the water flow path. An actuator mechanism is connected to the valve body for selectively pivoting the valve body between its first and second positions.

The present invention also provides a method of shutting off the flow of water through a sprinkler having a housing with a water flow path extending therethrough and a nozzle mounted in an upper end of the housing that provides an extension of the water flow path for distributing a stream of water outward from the housing. The first step of the method involves inserting a tool into the upper end of the housing to engage a drive member mounted in the housing. The next step of the method involves manually moving the tool a sufficient amount so that movement of the drive member that is conveyed to a valve body positioned in the water flow path will pivot the valve body from a first position in which it which the water flow path is substantially unobstructed to a second position in which the valve body substantially closes off the water flow path.

DESCRIPTION OF THE PREFERRED EMBODIMENT

Figure 1:
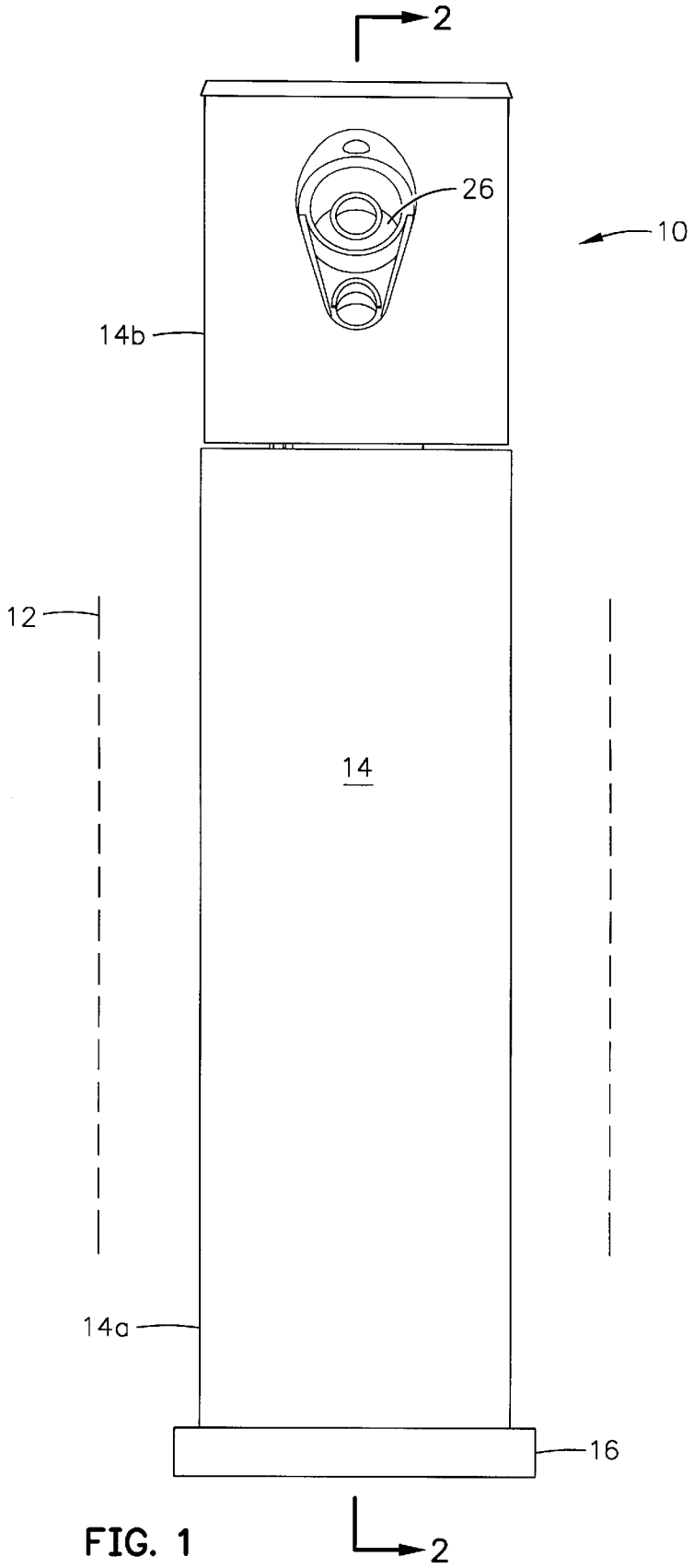
FIG. 1 is a side elevation view of a riser of a pop-up sprinkler forming a preferred embodiment of the present invention.

Referring to FIG. 1, an irrigation sprinkler 10 includes an outer cylindrical body shown diagrammatically as a pair of vertical dashed lines 12 and an inner cylindrical housing 14 vertically reciprocable within the outer body and including internal components to provide a pop-up riser. The outer body 10 has a lower end (not shown) that is coupled to a source of pressurized water turned ON and OFF by an irrigation controller. The inner housing 14 is normally held in a lower retracted position within the outer body 12 by a riser retraction spring (not shown). When water pressure is applied, the inner housing moves upwardly to an extended position, compressing the retraction spring between a shoulder 16 on the lower end of the inner housing an a split containment ring at the upper end of the outer body 12. See, for example, U.S. patent application Ser. No. 09/143,906 filed Aug. 31, 1998 of Mike Clark et al. entitled CO-MOLDED SPLIT CONTAINMENT RING FOR RISER RETRACTION SPRING OF A POP-UP SPRINKLER, now U.S. Pat. No. 6,082,632 granted Jul. 4, 2000, the entire disclosure of which is specifically incorporated herein by reference. The aforementioned application is also assigned to Hunter Industries, Inc. See also U.S. Pat. No. 5,762,270 of Kearby et al. granted Jun. 9, 1998 and entitled SPRINKLER UNIT WITH FLOW STOP, the entire disclosure ofwhich is specifically incorporated herein by reference.

Figure 2:
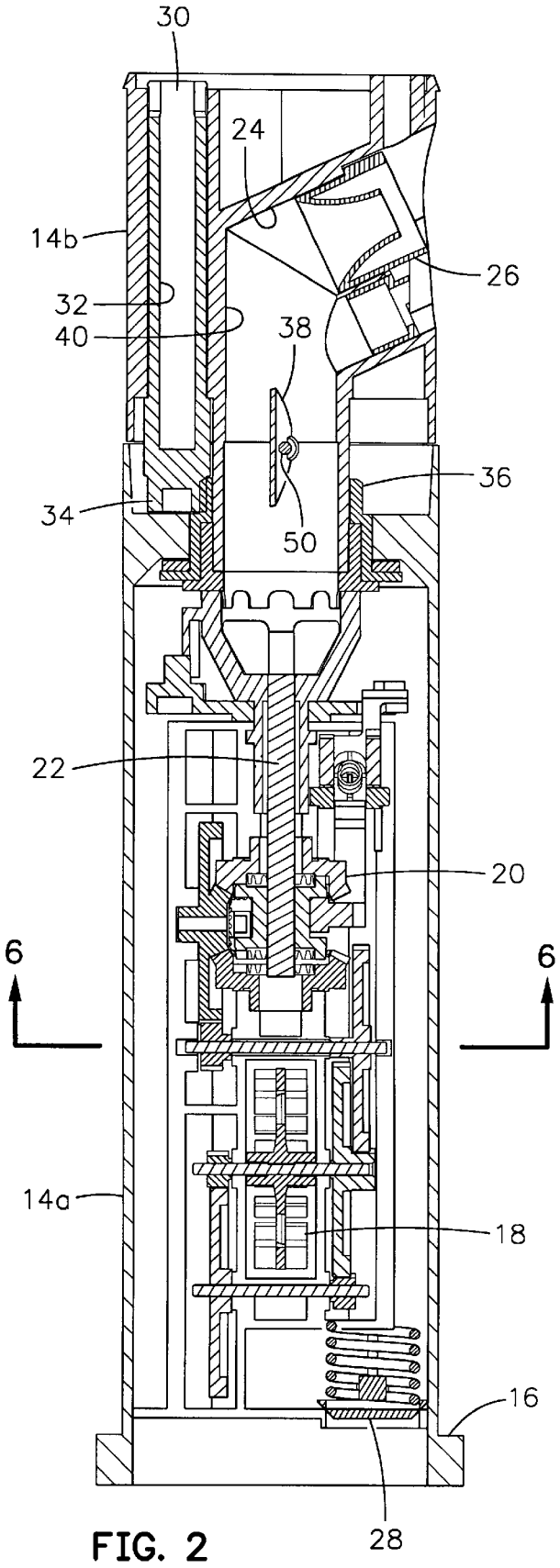
FIG. 2 is a vertical sectional view of the riser taken along line 2—2 of FIG. 1 showing its shut off valve body pivoted to its fully open position.
Figure 17:
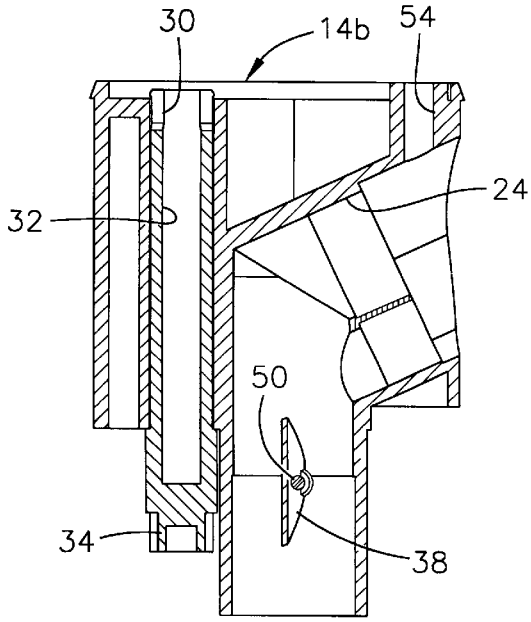
FIG. 17 is a vertical sectional view of the head taken along line 17—17 of FIG. 15.

Referring still to FIG. 1, the inner housing 14 includes a lower portion 14*a* and an upper head 14*b*. The lower portion 14*a* encloses a turbine 18 (FIG. 2) that drives a gear drive assembly 20. The gear assembly 20 drives a vertical drive shaft 22 for rotating the head 14*b* about a central vertical axis of the housing 14 relative to the lower portion 14*a* of the housing 14. The head 14*b* includes an upwardly inclined nozzle socket 24 (FIG. 17) for removably receiving a double orifice nozzle 26 (FIG. 2). The inner housing 14 has a water flow path extending therethrough that begins with a spring biased check valve 28 at its lower end and terminates with the nozzle 26 at its upper end. The nozzle 26 provides an extension of the water flow path for distributing two upwardly inclined streams of water outward from the inner housing 14.

Figure 4:
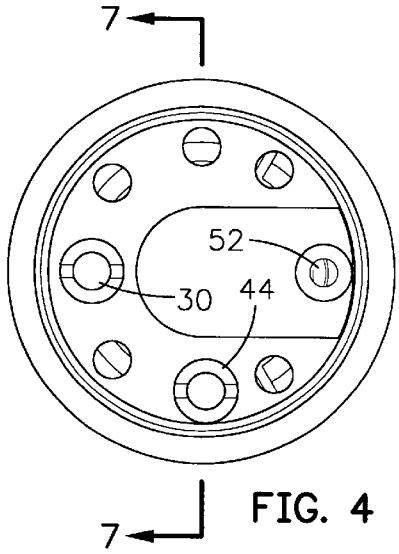
FIG. 4 is a top plan view of the riser of FIG. 1.
Figure 5:
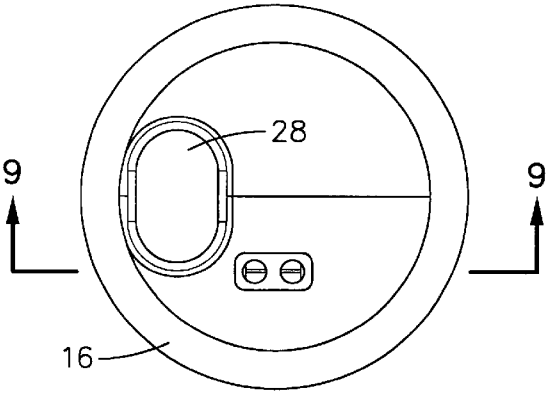
FIG. 5 is a bottom plan view of the riser of FIG. 1.
Figure 6:
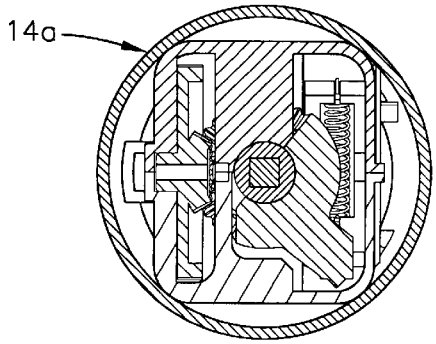
FIG. 6 is a horizontal sectional view of the riser taken along line 6—6 of FIG. 2.

The gear drive assembly 20 (FIG. 2) includes a reversing mechanism so that head 14*b* will rotate through a preselected arc. The size of the arc can be manually adjusted by inserting the flanged end of a tool 100 (FIG. 18) into the slotted upper end of an arc adjustment socket 30 (FIGS. 2 and 4). The arc adjustment socket 30 is formed on the upper end of a tubular shaft 32 (FIG. 2). A pinion gear 34 on the lower end of the shaft 32 engages a bull gear 36 that moves the angular position of one end limit of the arc, as is well known to those of ordinary skill in the design of irrigation sprinklers. See for example U.S. Pat. Nos. 3,107,056; 4,568,024; 4,624,412; 4,718,605 and 4,948,052 of Edwin J. Hunter, the entire disclosures of which are specifically incorporated herein by reference. The reversal mechanism in the gear drive assembly 20 has a memory arc mechanism so that if a vandal rotates the head 14*b* past the end limits of its pre-set arc, the head 14*b* will rotate back between the end limits so that its streams of water will thereafter resume spraying only between the pre-set arc limits. Thus the turbine 18 and the adjustable arc drive linkage including the gear drive assembly 20 are operatively coupled to the head

14*b* for rotating the nozzle 26 through an adjustable arc as water flows upwardly through the inner housing 14.

Figure 3:
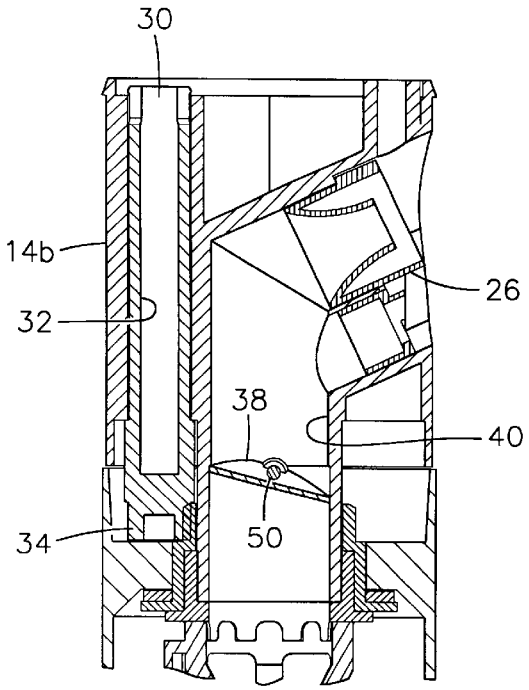
FIG. 3 is a fragmentary vertical sectional view similar to FIG. 2 showing the shut off valve pivoted to its fully closed position.
Figure 7:
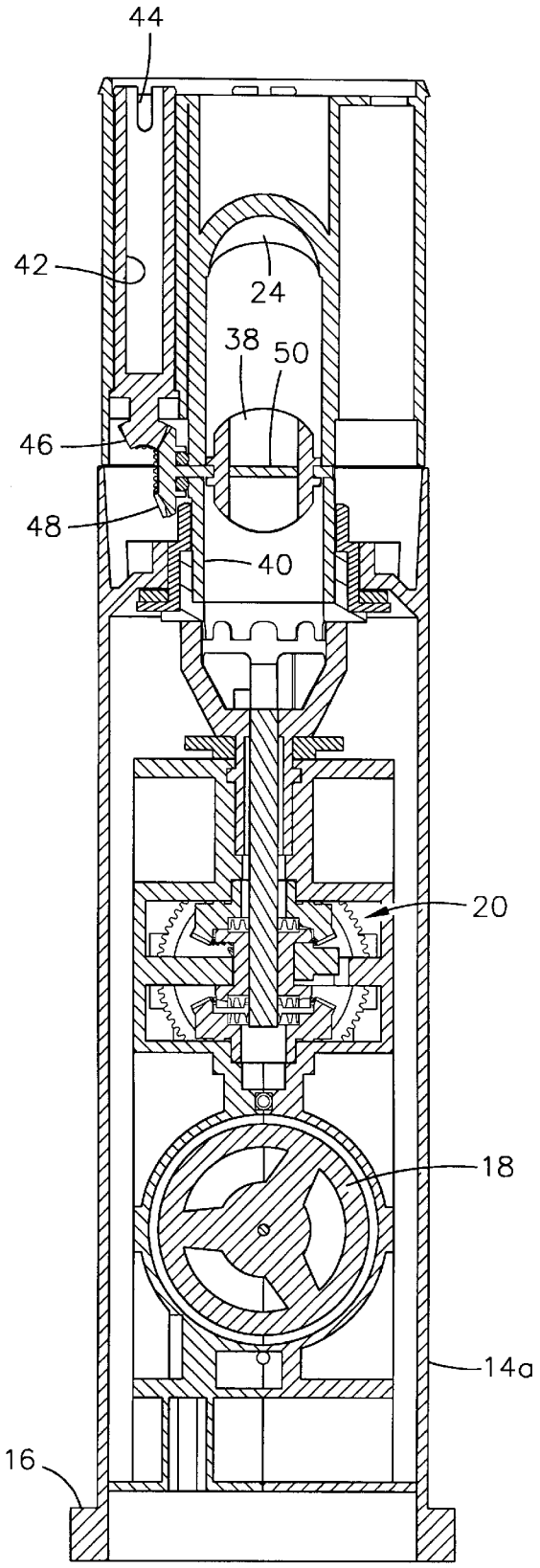
FIG. 7 is a vertical sectional view of the riser taken along line 7—7 of FIG. 4 showing its shut off valve body pivoted to its fully open position.
Figure 8:
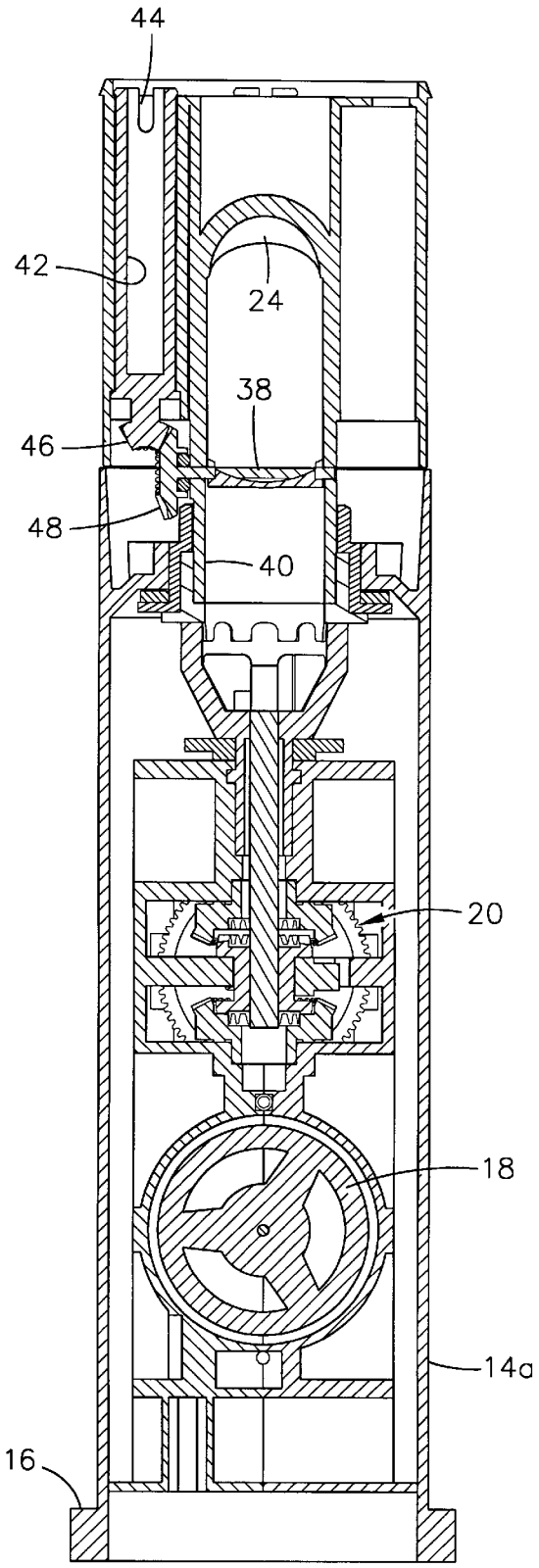
FIG. 8 is a vertical sectional view similar to FIG. 7 showing the shut off valve pivoted to its fully closed position.
Figure 9:
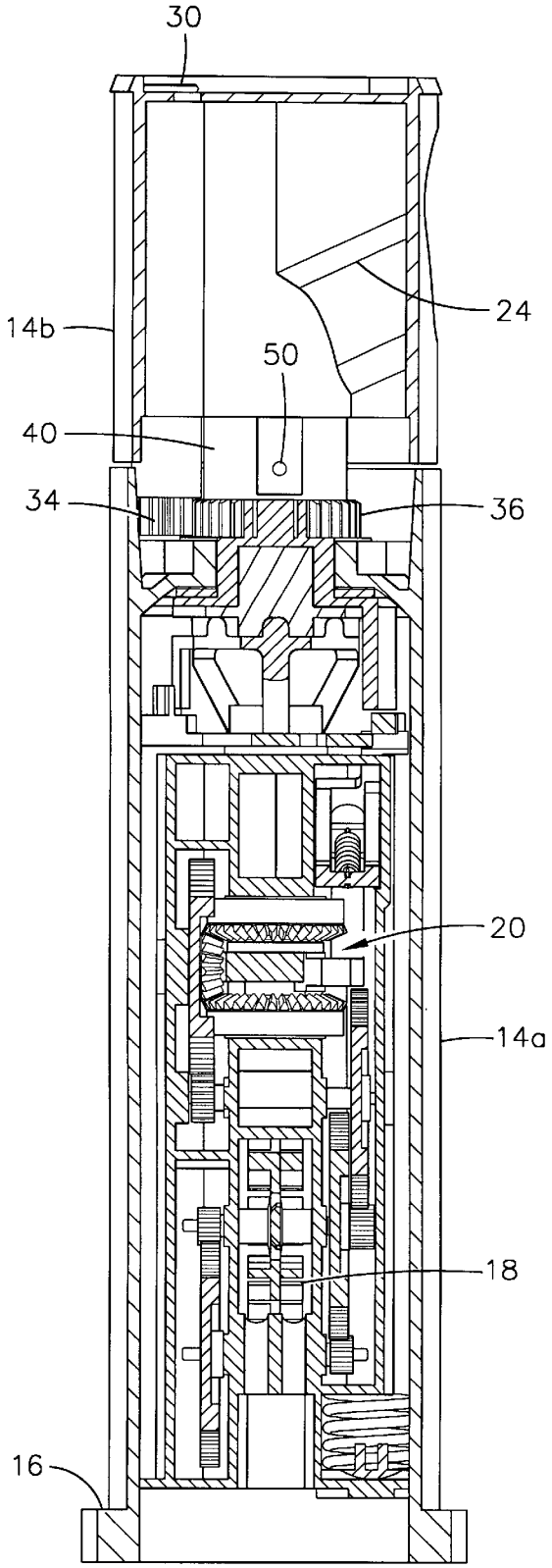
FIG. 9 is a vertical sectional view of the riser taken along line 9—9 of FIG. 5.

A valve body 38 (FIG. 2) is pivotable in the portion of the water flow path through the housing 14 formed by a vertical hollow cylindrical tube 40. The upper end of the tube 40 is formed integrally with the rear end of the angled nozzle socket 24. The valve body 38 is pivotable between a first position shown in FIGS. 2 and 7 in which it which the water flow path is open and a second position shown in FIGS. 3 and 8 in which the valve body 38 closes and seals off the water flow path.

Figure 10:
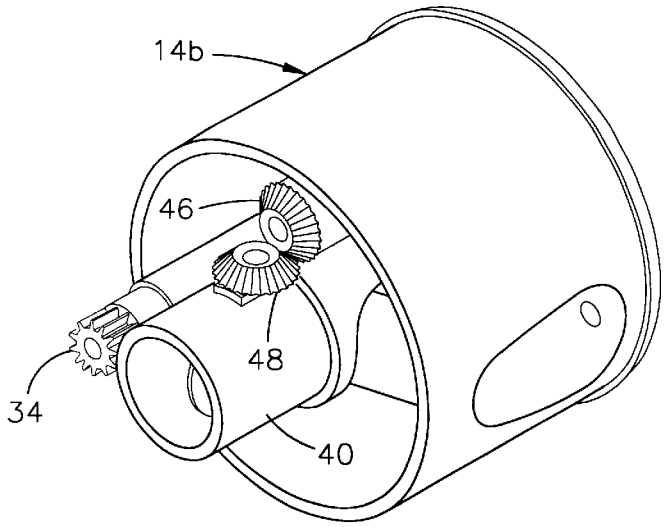
FIG. 10 is a perspective view of the head of the riser of FIG. 1 taken from the underside thereof.
Figure 11:
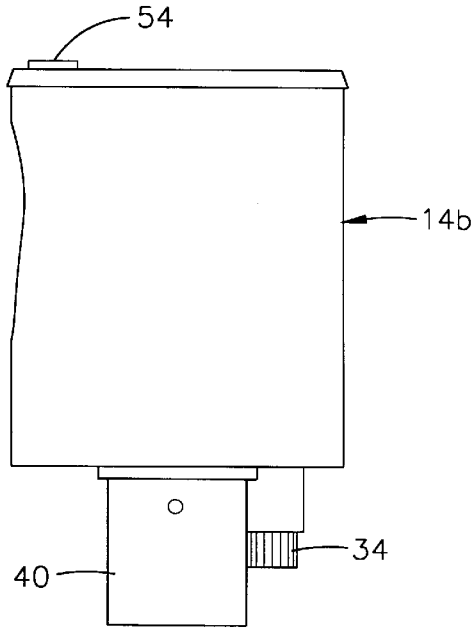
FIG. 11 is a side elevation view of the head shown in FIG. 10.
Figure 12:
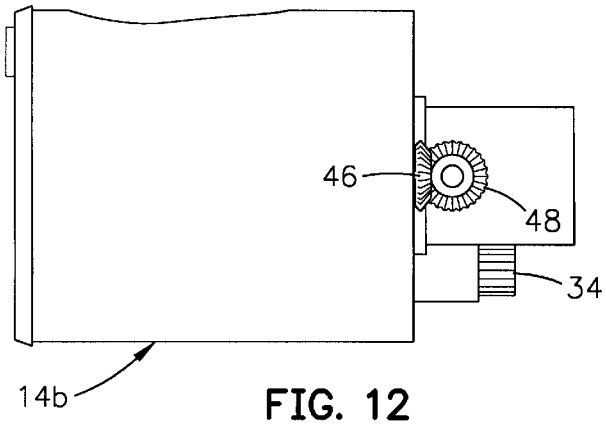
FIG. 12 is another side elevation view of the head of FIG. 10 taken from a different rotational angle to show details of the manually operated actuator mechanism that is used to pivot the valve body between its open and closed positions.
Figure 13:
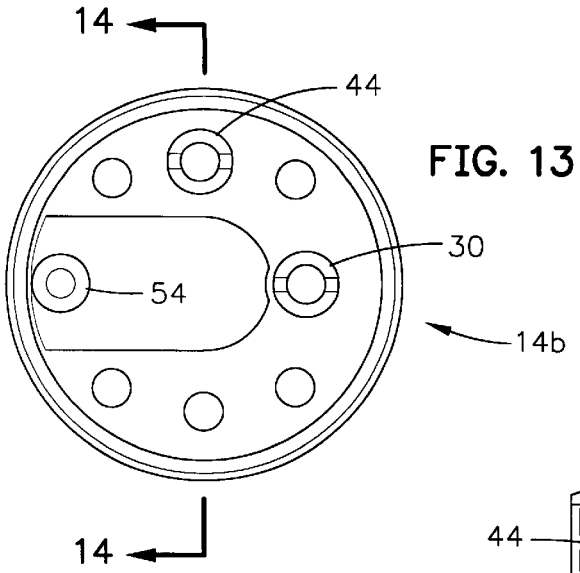
FIG. 13 is a top plan view of the head similar to FIG. 4 but oriented differently to facilitate referencing the sectional view of FIG. 14.
Figure 14:
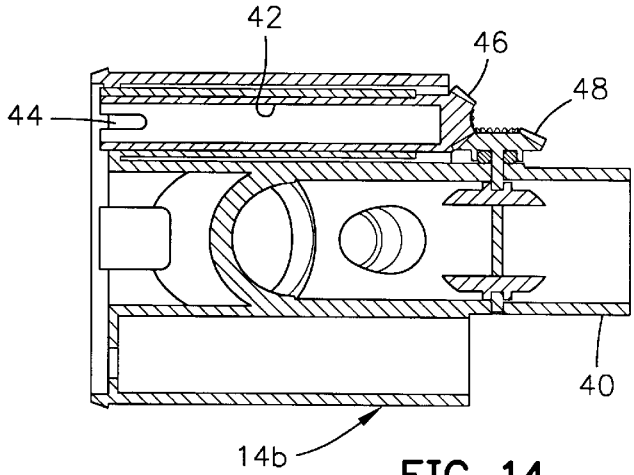
FIG. 14 is a vertical sectional view of the head taken along line 14—14 of FIG. 13.
Figure 15:
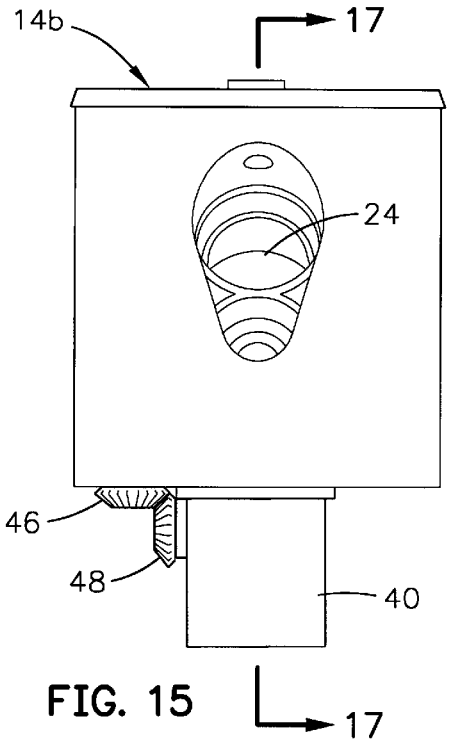
FIG. 15 is another side elevation view of the head taken from a different rotational angle to show its nozzle socket.
Figure 16:
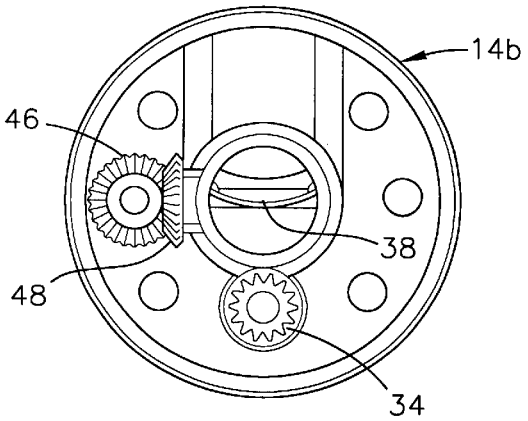
FIG. 16 is a bottom plan view of the head taken from the bottom of FIG. 15.
Figure 18:
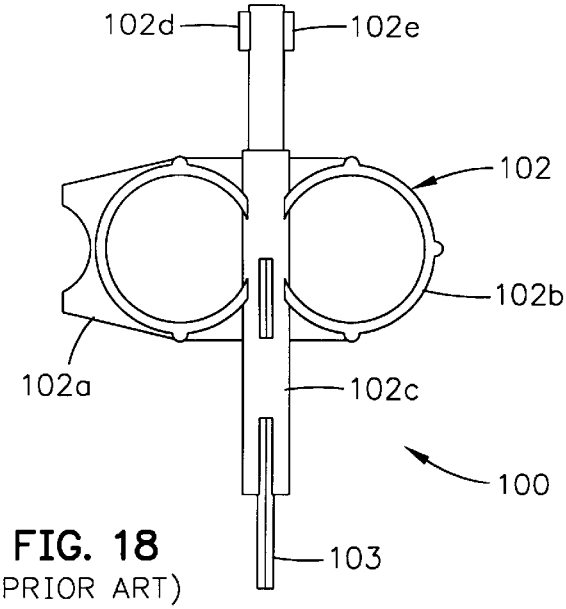
FIG. 18 (PRIOR ART)
FIG. 18 is an enlarged view of a conventional tool that may be inserted into a socket in the upper end of the head of the riser of FIGS. 1–17 to manually pivot valve body to shut off the flow of water through the riser.

A manually operable shut off valve actuator mechanism is connected to the valve body 38 for selectively pivoting the valve body 38 between its first and second positions. This actuator mechanism includes a drive shaft 42 (FIG. 7) moveable from the exterior of the head 14*b* with the slotted end of the tool 100 (FIG. 18). The slotted end of the tool 100 in inserted into a drive member in the form of a slotted socket 44 (FIGS. 4 and 7) connected to the upper end of the drive shaft 42. A first bevel gear 46 (FIGS. 7 and 10) is connected to the lower end of the drive shaft 42. The first bevel gear 46 meshes with a second bevel gear 48 connected to the end of a pivot shaft 50 that extends across the middle of, and supports, the valve body 38. The bevel gears 46 and 48 thus allow the rotational motion of the drive shift 42 to be translated through a ninety degree angle to pivot the valve body 38 about a horizontal axis. The drive shaft 42 and the bevel gears 46 and 48 provide a drive linkage that extends within the head 14*a* of the housing 14 exterior of the water flow path. This drive linkage connects the drive member 44 and the valve body 38 so that a predetermined amount of angular movement of the drive member 44 pivots the valve body 38 between its first and second positions shown in FIGS. 2 and 3, respectively.

FIGS. 10–17 are a series of perspective, elevation, plan and section views of the head 14*b* that show the aforementioned structure in detail. The pivot shaft 50 extends through holes in the cylindrical tube 40 that forms a part of the water flow path. A radius adjustment screw 52 (FIG. 4) can be screwed up and down in a sleeve 54 (FIG. 17) formed in the head 14*b* so that its lower end can partially intercept the upper stream of water ejected from the nozzle 26. This will change the range of this stream and/or provide a partial diversion of the upper stream to the turf area near the sprinkler 10. The top portion of the head 14*b* may be provided with a disk-shaped cover made of an elastomeric material with criss-cross apertures aligned with the sockets 30 and 44 through which the tool 100 may be inserted. This provides a water-proof cover that prevents water from filling the sockets 30 and 44.

The valve body 38 preferably has a slightly elliptical shape and is curved in section and downwardly concave when in its closed position. The valve body 38 can pivot to its vertical open position shown in FIGS. 2 and 7 in which it is substantially parallel with the curved cylindrical interior wall of an internal flow tube 40 to minimize water flow resistance. Due to its elliptical shape, the valve body can pivot to its substantially horizontal position shown in FIGS. 3 and 8 in which its peripheral edges are snug up against the cylindrical interior wall of the internal flow tube 40 in order to achieve a substantial seal. Tolerance problems that would otherwise be associated with a circular butterfly valve are avoided. The downwardly concave shape of the valve body 38 when in its closed position and its slightly over-the-center pivotal mounting on the shaft 50 result in the water pressure acting to hold the valve body 38 in its fully closed position until manually pivoted to its open position.

Besides operating as a shut off valve, the pivoting valve body 38 of the present invention can operate as a flow adjustment valve. That is to say, the valve body 38 can be moved to any desired position between its fully open and fully closed positions to reduce the volume and/or range of the water stream ejected from the nozzle 26. A continuously adjustable flow range is thus provided.

FIG. 18 is an enlarged view of a conventional tool 100 that may be inserted into the socket 44 in the upper end of the head 14*b* of the riser 14 and twisted in order to manually pivot valve body 38 to shut off the flow of water through the riser 14. The tool 100 may also be inserted into the socket 30 and twisted used to adjust one of its arc limits. The tool 100 includes a molded plastic grippable portion 102 and a central metal rod portion 103. The grippable plastic portion 102 includes a pair of finger rings 102*a* and 102*b* formed on opposite sides of a central support sleeve 102*c*. The support sleeve 102*c* surrounds and holds a majority of the metal rod portion 103. The grippable plastic portion 102 further includes a pair of small rectangular flanges 102*d* and 102*e* that extend from opposite sides of the lower end of the support sleeve 102*c*. The outer lateral edges of the two flanges 102*d* and 102*e* fit within diametrically extending slots of either of the sockets 30 or 44 to provide a positive, i.e. non-slip drive coupling.

The present invention also provides a method of shutting off the flow of water through a sprinkler 10 having a housing 14 with a water flow path extending therethrough and a nozzle 26 mounted in an upper end 14*b* of the housing 14 that provides an extension of the water flow path for distributing a stream of water outward from the housing 14. The first step of the method involves inserting the tool 100 into the upper end 14*b* of the housing 14 to engage a drive member 42 mounted in the housing 14. The next step of the method involves manually moving the tool 100, via rotation, a sufficient amount so that movement of the drive member 42 that is conveyed to the valve body 38 positioned in the water flow path will pivot the valve body 38 from a first position (FIGS. 2 and 7) in which it which the water flow path is substantially unobstructed to a second position (FIGS. 3 and 8) in which the valve body 38 substantially closes off the water flow path.

It can thus be seen that the pop-up rotor type sprinkler 10 has a flow shut off capability that is manually actuated from a top side of the riser 14 via a conventional adjustment tool 100. When the sprinkler 10 is pressurized with water, the riser 14 will extend from within the outer body 12. The flow of water through the sprinkler 10 may then be shut off by pivoting the valve body 38 closed. This allows the nozzle 26 to be removed and replaced with a nozzle having a different precipitation rate or flow pattern. Such nozzles are disclosed in U.S. Pat. No. 5,456,411 of Scott et al. granted Oct. 10, 1995 and entitled QUICK SNAP NOZZLE SYSTEM, the entire disclosure of which is hereby incorporated by reference. Said patent is also assigned to Hunter Industries, Inc. The flow shut offcan readily be accomplished without having to turn off the solenoid for the zone encompassing the sprinkler or interrupting the program of the irrigation controller. Also, if the area around the sprinkler 10 is getting excessive water, it can be manually turned off for several days without having to alter the watering program of the irrigation controller. An important advantage of the present invention is that the linkage that connects the drive member 44 with the valve body 38 is entirely outside the water flow path so that the hydrodynamics of the twin water streams flowing out of the nozzle 26 are not adversely affected as in the case of the arrangement disclosed in the aforementioned U.S. Pat. No. 5,762,270 of Kearby et al. Furthermore, the valve body 38 pivots into a parallel alignment with the water flow in the tube 40, which minimizes its flow resistance. Substantial flow resistance results in the arrangement of U.S. Pat. No. 5,762,270 where a disk shaped valve body is axially moved into and out of engagement with a valve seat surrounding the cylindrical water flow path. When the valve member is moved off of the valve seat, the water has to flow up and around the disk shaped valve body.

The present invention is suitable for large sprinklers where the pressures in the flow path can be as high as sixty PSI. The pivot shaft 50 carries most of the load and very little force is needed to pivot the counter-balanced valve body 38. In the design of the shut off valve in U.S. Pat. No. 5,762,270, the size of the valve body, stem and actuating member become excessively large.

While a preferred embodiment of the present invention has been described in detail, other embodiments will be readily apparent to those skilled in the art. For example, the valve body 38 could be co-molded with a rigid plastic interior support element surrounded by an elastomeric covering to enhance the ability of the valve body 38 to provide a leak-proof closure when pivoted to its filly closed position. Therefore, the protection afforded the present invention should only be limited in accordance with the scope of the following claims.

What is claimed is:

1. A method of shutting off the flow of water through an irrigation sprinkler having a vertically reciprocable inner housing with a water flow path extending therethrough and a nozzle mounted in an upper end of the inner housing providing an extension of the water flow path for distributing a stream of water outward from the inner housing, the inner housing being vertically reciprocable within an outer body, comprising the steps of:

inserting a tool into an exterior of an upper end of the inner housing to engage a drive member mounted in the inner housing; and manually moving the tool a sufficient amount so that movement of the drive member that is conveyed to a valve body positioned in the water flow path will pivot the valve body from a first position in which the water flow path is substantially unobstructed to a second position in which the valve body substantially closes off the water flow path.

2. An irrigation sprinkler, comprising:

a housing having a water flow path extending therethrough;

a nozzle mounted in an upper end of the housing and providing an extension of the water flow path for distributing a stream of water outward from the housing;

a valve body pivotable in the water flow path between a first position in which the water flow path is substantially open and a second position in which the valve body substantially obstructs the water flow path, the valve body being pivotable about an axis that extends transversely across a major dimension of the valve body; and an actuator mechanism connected to the valve body for selectively pivoting the valve body between its first and second positions.

3. The irrigation sprinkler of claim 2 wherein the valve body has a generally elliptical configuration.

4. The irrigation sprinkler of claim 3 wherein the water flow path has a generally rounded cross-section and the valve body is configured to conform to an internal curved wall of the path.

5. The irrigation sprinkler of claim 2 wherein the axis extends substantially across a diameter of the valve body.

6. The irrigation sprinkler of claim 2 wherein the actuator mechanism connected to the valve body is manually operable from an upper end of the housing for permitting a user to manually pivot the valve body to open and obstruct the water flow path.

7. The irrigation sprinkler of claim 6 wherein the valve body is pivotable about the axis such that when it is in the first position the valve body is substantially parallel with a curved interior wall of the water flow path.

8. The irrigation sprinkler of claim 2 wherein the valve body is configured and pivotable so that when the valve body is in the second position the flow of water through the nozzle is substantially shut off.

9. The irrigation sprinkler of claim 2 wherein the valve body is curved in cross section and is downwardly concave when in the second position.

10. The irrigation sprinkler of claim 2 wherein the actuator mechanism does not obstruct the water flow path.

11. The irrigation sprinkler of claim 2 wherein the actuator mechanism connected to the valve body is manually operable from the exterior of an upper end of the housing for permitting a user to manually pivot the valve body to selectively open and obstruct the water path.

12. The irrigation sprinkler of claim 2 wherein the upper end of the housing includes a nozzle socket for removably receiving one of a plurality of mating nozzles providing different precipitation rates.

13. The irrigation sprinkler of claim 2 wherein the actuator mechanism includes a drive member mounted in the upper end of the housing above the nozzle and accessible from a top side of the upper end of the housing with a tool having a portion configured for engaging and moving the drive member.

14. The irrigation sprinkler of claim 13 wherein the drive member is rotatable with the tool.

15. The irrigation sprinkler of claim 13 wherein the actuator mechanism includes a linkage connecting the drive member and the valve body.

16. The irrigation sprinkler of claim 15 wherein the linkage extends within the upper end of the housing exterior of the nozzle so that the linkage does not obstruct the water flow path.

17. An irrigation sprinkler, comprising:

a housing having a water flow path extending therethrough;

a nozzle mounted in an upper end of the housing and providing an extension of the water flow path for distributing a stream of water outward from the housing;

a valve body moveable in the water flow path between a first position in which the water flow path is substantially open and a second position in which the valve body substantially obstructs the water flow path, the valve body being moveable about an axis that traverses the water flow path; and an actuator mechanism connected to the valve body for selectively moving the valve body between its first and second positions, the actuator mechanism being mounted substantially externally of the water flow path.

18. The irrigation sprinkler of claim 17 wherein the housing is vertically reciprocable within an outer body to form a riser and the irrigation sprinkler further comprises a turbine and an adjustable arc drive linkage mounted in the housing and operatively coupled to the nozzle for rotating the nozzle through a preselected arc.

19. The irrigation sprinkler of claim 17 wherein the valve body is pivotable about the axis that traverses the flow path.

20. The irrigation sprinkler of claim 17 wherein the valve body is mounted within a first segment of the flow path that precedes a second segment of the path defined by the nozzle.

21. An irrigation sprinkler, comprising:

a cylindrical housing having a first segment of a water flow path extending therethrough in a direction substantially parallel with a first axis of the housing;

a nozzle mounted in an upper end of the housing and defining a second segment of the water flow path connected to the first segment of the water flow path for distributing a stream of water outward from the housing;

a valve body moveable in the first segment of the water flow path about a second axis non-parallel to the first axis between a first position in which the the first segment of the water flow path is substantially open and a second position in which the valve body substantially obstructs the first segment of the water flow path; and an actuator mechanism connected to the valve body for selectively moving the valve body between its first and second positions.

22. The irrigation sprinkler of claim 21 wherein the valve body is pivotable about an axis that traverses the first segment of the water flow path.

23. The irrigation sprinkler of claim 22 wherein the valve body is mounted for over center pivoting to enable water pressure on an underside of the valve body to hold the valve body in its second position.

24. The irrigation sprinkler of claim 21 wherein the actuator mechanism connected to the valve body is manually operable from an exterior of an upper end of the housing for permitting a user to manually move the valve body to selectively open and obstruct the first segment of the water path flow path.

25. The irrigation sprinkler of claim 21 wherein the actuator mechanism is mounted substantially externally of the water flow path.

26. The irrigation sprinkler of claim 21 wherein the actuator mechanism includes a linkage connecting the drive member and the valve body and the linkage extends within the upper end of the housing exterior of the nozzle so that the linkage does not obstruct the first or second segments of the water flow path.

27. A irrigation sprinkler, comprising:

an outer body;

an inner housing having a water flow path extending therethrough, the housing being vertically reciprocable within the outer body to provide a riser;

a nozzle mounted in an upper end of the housing and providing an extension of the water flow path for distributing a stream of water outward from the housing;

a turbine and an adjustable arc drive linkage mounted in the housing operatively coupled to the nozzle for rotating the nozzle through an adjustable arc as water flows through the turbine;

a valve body pivotable in the water flow path through the inner housing between a first position in which the the water flow path is open and a second position in which the valve body closes the water flow path; and a manually operable actuator mechanism extending through the inner housing and connected to the valve body for selectively pivoting the valve body between its first and second positions, including a drive member moveable from the exterior of an upper end of the inner housing with a tool and a linkage extending within the inner housing substantially exterior of the flow path and connecting the drive member and the valve body so that a predetermined amount of movement of the drive member pivots the valve body between the first and second positions.

28. The irrigation sprinkler of claim 27 wherein the valve body has a generally elliptical configuration.

29. The irrigation sprinkler of claim 28 wherein the water flow path has a curved cross-section and the valve body is configured to conform to an internal curved wall of the path.

30. The irrigation sprinkler of claim 2 wherein the actuator mechanism includes a drive member mounted in the upper end of the housing above the nozzle and accessible from a top side of the upper end of the housing with a tool having a portion configured for engaging and moving the drive member.

* * * * *